US006659316B2

(12) United States Patent
Fleming et al.

(10) Patent No.: US 6,659,316 B2
(45) Date of Patent: Dec. 9, 2003

(54) CONVERTIBLE QUIVER FOR CARRYING FENCING OR OTHER EQUIPMENT AND TOOLS

(76) Inventors: Rebecca B Fleming, 11 Wedgewood Ct., Manhasset, NY (US) 11030; Judith B Esterquest, 11 Wedgewood Ct., Manhasset, NY (US) 11030

( * ) Notice: Subject to any disclaimer, the term of this patent is extended or adjusted under 35 U.S.C. 154(b) by 24 days.

(21) Appl. No.: 10/059,921

(22) Filed: Jan. 29, 2002

(65) Prior Publication Data

US 2003/0141335 A1 Jul. 31, 2003

(51) Int. Cl.[7] ..... A45F 3/02; A63B 55/06; A63B 55/10; A63B 69/02; A63B 71/00

(52) U.S. Cl. ..... 224/0.5; 224/613; 206/315.2; 206/315.11; 206/317; 211/70.2; 211/70.8; 294/143

(58) Field of Search ..... 224/613, 257, 224/916, 922, 0.5; 294/143; 206/315.1, 315.2, 315.7, 315.11, 317; 43/26; 211/70.2, 70.8

(56) References Cited

U.S. PATENT DOCUMENTS

| | | | | | |
|---|---|---|---|---|---|
| 1,314,171 | A | * | 8/1919 | Vogel | 211/70.2 |
| 1,563,816 | A | | 12/1925 | Worthington | 206/310.2 |
| 1,904,231 | A | * | 4/1933 | Hodgman | 211/70.2 |
| 1,951,492 | A | * | 3/1934 | Schneider | 206/315.2 |
| 2,118,875 | A | | 5/1938 | Windheim | |
| 2,464,101 | A | | 3/1949 | Schoenike | 206/315.11 |
| 2,681,232 | A | * | 6/1954 | Womack | 206/315.2 |
| 2,799,315 | A | * | 7/1957 | Strasburg | 206/315.7 |
| 2,858,868 | A | * | 11/1958 | Wallace | 206/315.2 |
| 2,950,748 | A | * | 8/1960 | Olinghouse | 206/315.2 |
| 2,970,629 | A | * | 2/1961 | Masten | 206/215.2 |
| 3,164,185 | A | * | 1/1965 | Ingoldt | 206/315.2 |
| 3,495,641 | A | * | 2/1970 | Bethel | 206/315.2 |
| 3,866,646 | A | | 2/1975 | Nevard | |
| 3,902,634 | A | * | 9/1975 | Brumley et al. | 206/315.1 |
| 4,182,391 | A | | 1/1980 | Kjose | 206/315.3 |
| 4,308,982 | A | | 1/1982 | Hall | 224/202 |
| 4,371,022 | A | * | 2/1983 | Goulart | 206/315.2 |
| 4,628,628 | A | | 12/1986 | Burgin et al. | 206/315.11 X |
| 4,793,532 | A | | 12/1988 | Cash | 206/315.1 X |
| 4,911,347 | A | * | 3/1990 | Wilhite | 224/257 |
| 4,982,883 | A | | 1/1991 | Ullal et al. | 224/651 |
| 5,040,324 | A | | 8/1991 | Rivera et al. | 224/922 X |
| D329,744 | S | * | 9/1992 | Moore | D3/37 |
| 5,400,937 | A | | 3/1995 | Rottenberg | 324/258 |
| 5,573,122 | A | * | 11/1996 | Williams | 211/70.2 |
| 5,678,348 | A | | 10/1997 | Zielinski et al. | 224/922 X |
| 5,816,396 | A | * | 10/1998 | Shin | 206/315.3 |
| 6,267,425 | B1 | * | 7/2001 | Dorsey | 294/143 |

FOREIGN PATENT DOCUMENTS

| | | | |
|---|---|---|---|
| GB | 2267037 | A | * 11/1993 |

* cited by examiner

*Primary Examiner*—Sue A. Weaver

(57) ABSTRACT

This invention is a quiver for carrying sporting equipment or tools over the shoulder; it can be converted into a free-standing structure; and it can be disassembled when not in use for ease of storing and traveling. The quiver consists of a plurality of rigid tubes, with a means for holding the assembled tubes into a stable structure suspended from a shoulder strap. The quiver also allows peripheral equipment to be attached by such means as clips, hook-and-loop-type fasteners, hanging containers, and so forth. The shoulder strap is adjustable, for comfortable, hands-free carrying and for hanging the quiver from a chair, a hook, or other furnishing. Adding wheels allows the quiver to be rolled or carried. The quiver can also be converted into a stand which holds equipment off the ground. Further, after use, the quiver can easily be disassembled into individual protective casings for transport or shipping; when disassembled, the quiver components require less packing space.

12 Claims, 7 Drawing Sheets

Figure 5A
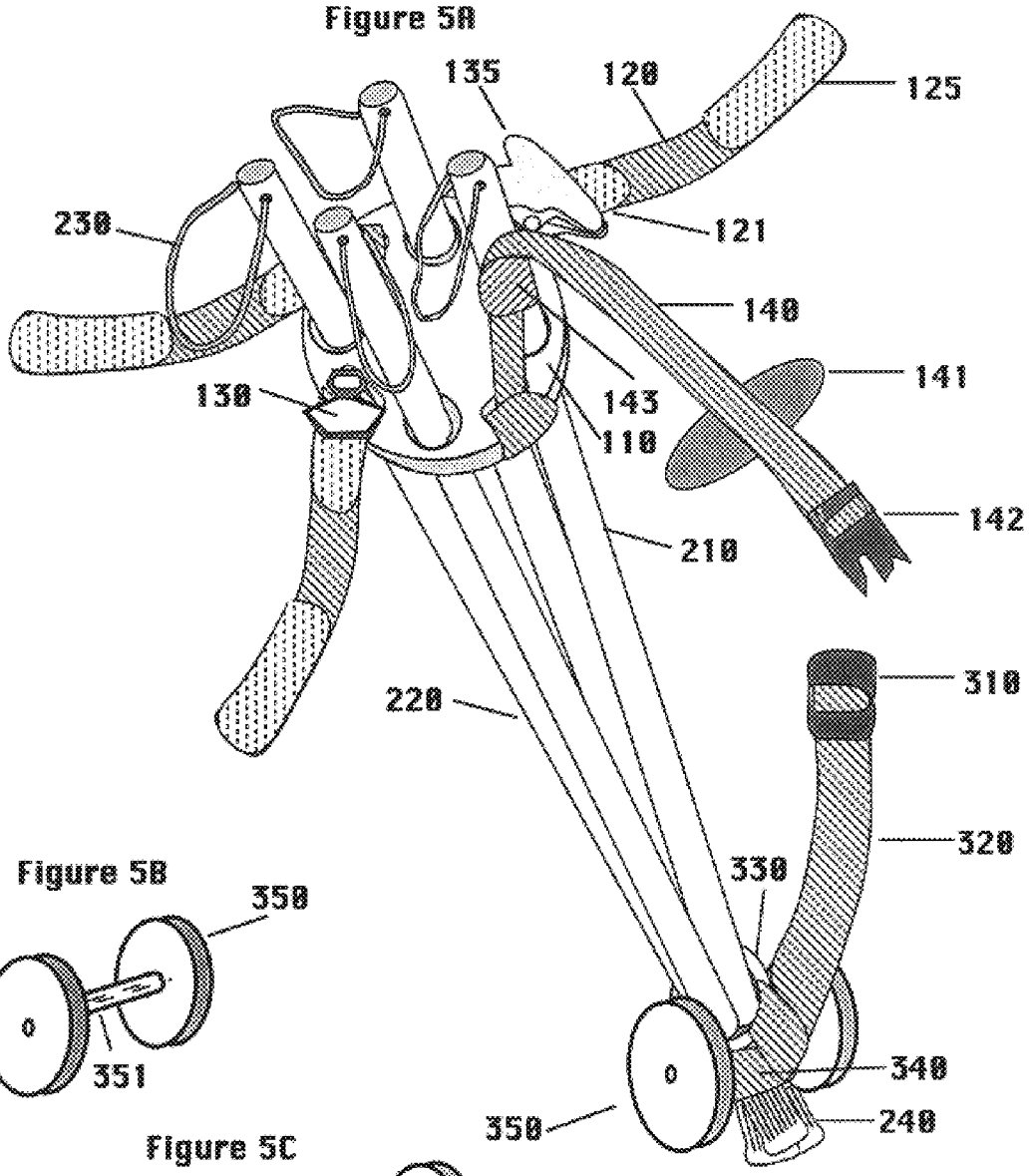
Figure 5B
Figure 5C
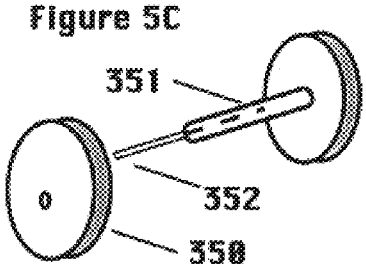

CONVERTIBLE QUIVER FOR CARRYING FENCING OR OTHER EQUIPMENT AND TOOLS

BACKGROUND OF THE INVENTION

1. Field of the Invention

This invention relates generally to carriers for sporting equipment or tools, namely fencing equipment and other peripheral equipment, and more particularly to a quiver that can be converted into a stand and can be disassembled with ease for storage or shipping. Its usefulness applies to the carrying of any elongated tools or equipment, particularly those with one irregularly shaped end and those which can be damaged by jostling.

2. Discussion of Prior Art

When fencers attend tournaments and practice sessions, they bring the protective and regulation equipment and tools they need in large and cumbersome sports bags, either hard or soft-sided. During the specific hours of competition, these bags are too unwieldy to be brought to the specific fencing strips where pairs of opponents compete, so fencers typically carry in their hands as many as 8 or 10 items: these can include such items as 3–4 weapons, 1–2 body cords, mask, glove, towel, water, snack, warm-up clothing. These differently shaped items are then left in loose piles on the floor near the fencing strip where they are often accidentally stepped on or kicked, sometimes resulting in damage. When as many as 8–10 fencers, plus coaches, teammates, relatives, friends, and observers, congregate around a specific strip, the many such piles of equipment sometimes occasion confusion as to which items belong to whom, especially when the exigencies of competition require the rapid collection and transport of these loose items to another strip. Rarely is there enough room to bring the large travel cases to the strip, even if transporting them around the fencing venue were not so difficult and cumbersome.

Those lightweight receptacles designed to be carried over the shoulder that are currently available do not allow easy access to multiple weapons, so they are rarely if ever brought to competition strips. Bringing them to competition venues would require transporting them empty, along with all the required fencing equipment, since they do not provide sufficient protection to be checked as baggage in airplanes or trains or even tightly packed automobile trunks.

Similarly, fencers who travel to lessons or practice sessions often need to transport only a limited quantity of equipment. Today, they must choose between large, wheeled carrying cases which are cumbersome or small cloth cases which overly limit what they can carry and which allow no protection to fragile items which jostle against each other during transport. Alternatively, fencers carry their equipment loose in their hands. Current art provides no lightweight, easy-to-carry receptacles for transporting multiple weapons nor any lightweight receptacles which protect weapon blades and points from damage nor any receptacles which can act as stands, holding weapons off the floor.

As for the prior art, inventions such as those to Nevard (U.S. Pat. No. 3,866,646), Worthington (U.S. Pat. No. 1,563,816), Hall (U.S. Pat. No. 4,308,982), Ullal et al. (U.S. Pat. No. 4,982,883), Zielinski et al. (U.S. Pat. No. 5,678,348), Rivera et al. (U.S. Pat. No. 5,040,324), Burgin et al. (U.S. Pat. No. 4,628,628), Windheim (U.S. Pat. No. 2,118,875), Rottenberg (U.S. Pat. No. 5,400,937), Cash (U.S. Pat. No. 4,793,532), Kjose (U.S. Pat. No. 4,182,391) and Schoenike (U.S. Pat. No. 2,464,101) all offer teachings of providing a means of transport for rod-like or lengthy sporting equipment.

Nevard discloses a golf club carrier which employs the use of tubes for receiving the clubs. Having tubes secured to the base, the structure of Nevard does not allow movement of the tubes which is the opposite concept taught herein. Worthington similarly teaches of a plurality of tubes for carrying golf clubs having a shoulder strap for carrying. However the tubes are bound together in a threaded manner via an interlacing strap allowing the tubes to be arranged in a flat to circular formation.

Hall, Ullal et al., Burgin et al., Windheim, and Rottenberg all illustrate the use of hands-free carrying of ski sporting equipment by harnessing skis over the shoulder and back. Wherein Windheim discloses a partially open and partially closed (sack-like) devices; Hall, Ullal, Burgin and Rottenberg illustrate open forms of an equipment harness.

Zielinski et al. discloses a portable fishing rod organizer having a pair of axially detached brackets for housing the rods. A carrying strap extends between the two brackets, although similar in concept (of accommodating transportation) to the present invention it departs in structure and usage in various ways. Rivera et al. and Burgin et al. also disclose equipment holders each providing means for carrying and restraining such elongated equipment.

The patents to Cash and Kjose illustrate the antithesis of the present invention providing equipment holders which are internally stored. Lastly, the patent to Schoenike discloses a quiver, in the conventional sense, providing means for spacing arrows during transport.

Deficiencies in the prior art for such other ramifications include golf bags which are cumbersome and heavy enough to require human caddies or golf carts and which allow unprotected golf clubs to jostle against each other; golf club carriers which are carried in the hand; tool carriers which allow elongated calibrated tools such as levels to knock against each other and which must be carried closed so that there is no immediate access to the tools; tool belts which allow immediate access to tools but from which elongated tools can be suspended only if very little walking is required; fishing rod carriers which must be carried by hand; fishing rod and backpack combinations which do not accommodate jostle-free transport of multiple rods or rods with reels attached; garden tool carriers designed to rest on the ground which must be constantly moved as the gardener moves down a row; soft-sided sports bags for baseball bats, hockey sticks, lacrosse sticks, and so forth, which must be carried by hand, often by more than one person, because their length makes them too cumbersome for someone of average height to carry alone.

SUMMARY OF THE INVENTION

Accordingly, it is therefore an object of the present invention to provide an improved device for carrying sporting equipment or tools more easily, safely and conveniently than prior art. While the above devices fulfill their respective, particular objective and requirements, the aforementioned patents do not describe a fencing quiver for elongated, irregularly shaped equipment which converts into a stand capable of carrying peripheral tools and equipment. In view of the foregoing disadvantages inherent in the known types of devices for carrying fencing equipment, or any elongated, rod-like equipment now present in the prior art, the present invention provides an improved device for carrying such equipment.

As such, the general purpose of the present invention, which will be described subsequently in great detail, is to provide a new and improved device for transporting such equipment which has all of the advantages of the prior art and none of the disadvantages. Therefore, it can be appreciated that there exists a continuing need for an improved device which can be used to carry fencing, or other irregularly shaped equipment. In this regard, the present invention substantially fulfills this need as described below.

Accordingly, this invention in its fencing ramification has several objects and advantages over prior art. Compared to other carriers, it is lighter in weight, smaller in volume and easier to carry than hard-sided cases which cannot be slung over a shoulder or chair or other furnishing; it is more protective of weapon blades and tips than soft-sided carriers; it is more protective of some peripheral equipment, such as body cords, than soft-sided carriers; its open structure allows immediate visual inventorying of equipment, unlike soft or hard-sided carriers; its open structure allows immediate access to required items.

Further, when it is converted into a stand, it can be used near fencing strips to hold spare weapons and equipment, keeping them off the floor, even when chairs or other furnishings are not available. Further, because it can be disassembled, it can be easily stored and transported when it is not in use. In its space-efficient disassembled state, it protects individual weapons against jostling and the moisture of damp uniforms.

Compared to hand-carrying equipment and then leaving equipment in piles near fencing competition strips, it provides more protection against damage from being stepped on or kicked because fragile equipment is in protective sheaths, both when used as a quiver and when used as a stand. Because it causes items being carried to be part of a single entity rather than loose, it protects items against being mistakenly removed by someone other than the owner and it reduces the chances that some items will be mistakenly left behind by the owner. It provides greater convenience in handling because the quiver carries equipment, leaving the hands free for other uses.

Because the quiver is constructed of lightweight components, it does not add significant weight to the equipment being carried. Further, because the components disassemble, it is possible to replace parts, should that be necessary, rather than replacing the entire quiver, giving economic advantage.

Thusly, the more important features of the invention have been outlined, rather broadly, in order that the detailed description thereof that follows may be better understood, and in order that the present contribution to the art may be better appreciated. There are, of course, additional features of the invention that will be described hereinafter and which will form the subject matter of the claims appended hereto.

BRIEF DESCRIPTION OF DRAWINGS

Features of the present invention which are believed to be novel are set forth with particularity in the appended claims. The invention, together with further objects and advantages thereof, may best be understood by reference to the following detailed description taken in conjunction with the accompanying sheets of drawings, in the figures of which like reference numerals identify like elements, and in which:

FIG. 5A is a perspective view of the convertible quiver being used as an equipment carrier with wheels;

FIG. 5B illustrates the wheel assembly;

FIG. 5C shows the components of the wheel assembly;

DETAILED DESCRIPTION OF THE PREFERRED EMBODIMENT

Figure 1:
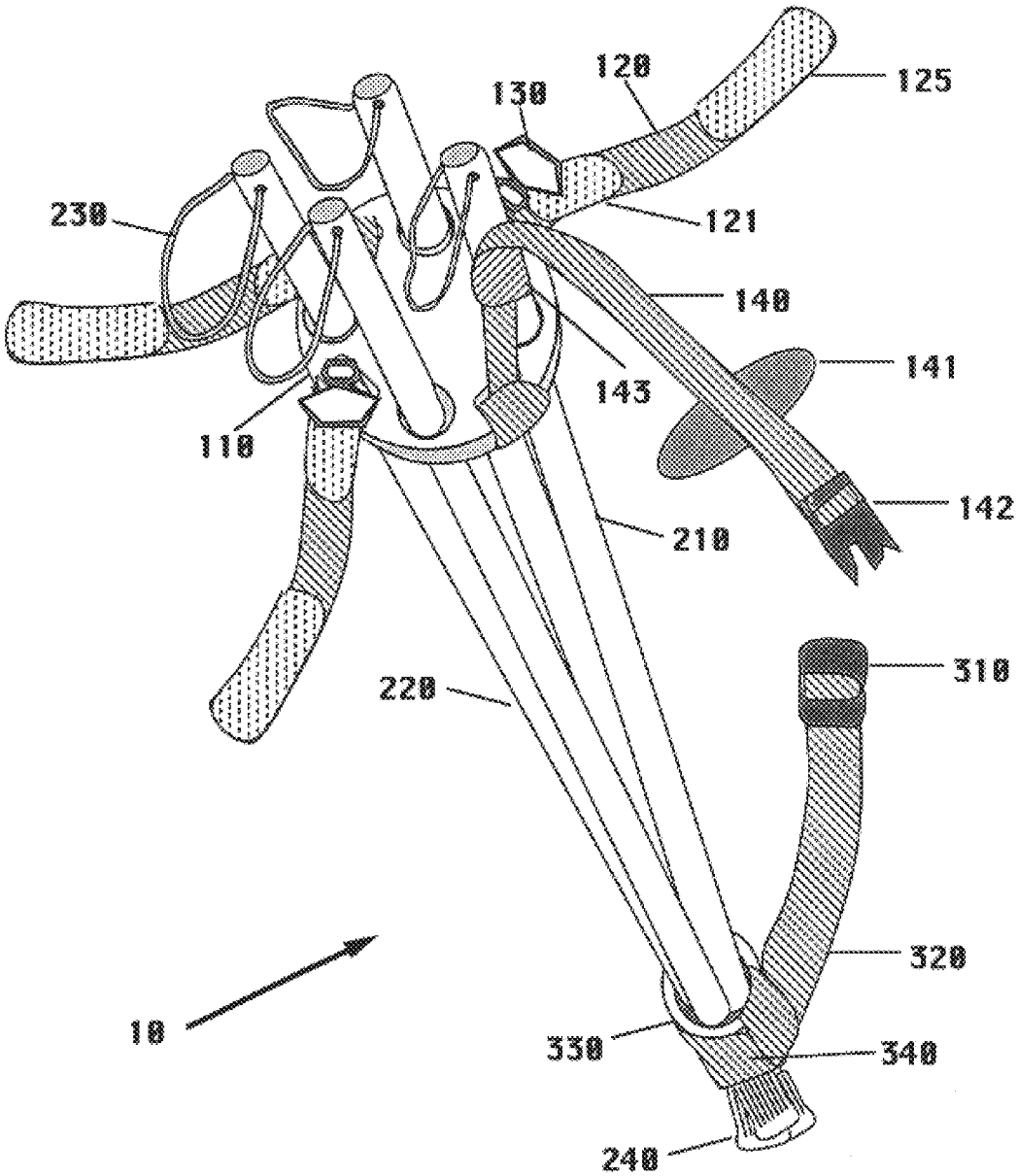
FIG. 1 is a perspective view of the convertible quiver being used as an equipment carrier.

In accordance with a preferred embodiment of the present invention is a convertible quiver 10 as illustrated in FIG. 1. In this disclosure, "convertible quiver" refers to a holder and carrier used to transport fencing or other sporting equipment or other tools. It is convertible in that the holder converts into a stand and in that it disassembles into space-conserving and protective storage sheaths. FIG. 1 shows the quiver 10 as it is assembled as a holder or carrier. As illustrated, there are a plurality of rod-like tubes 210 and 220 which house the necessary equipment.

Figure 2A:
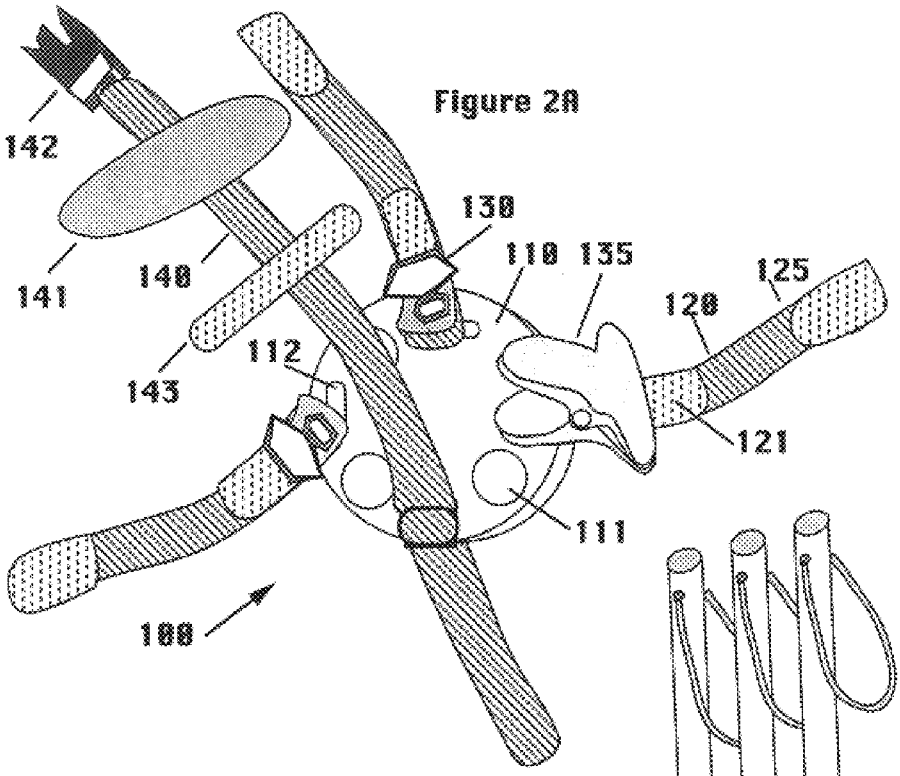
FIG. 2A is a front elevational view of the spacer assembly.
Figure 2B:
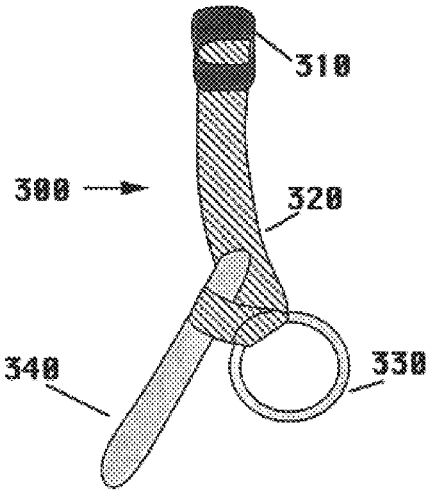
FIG. 2B illustrates the base assembly.
Figure 2C:
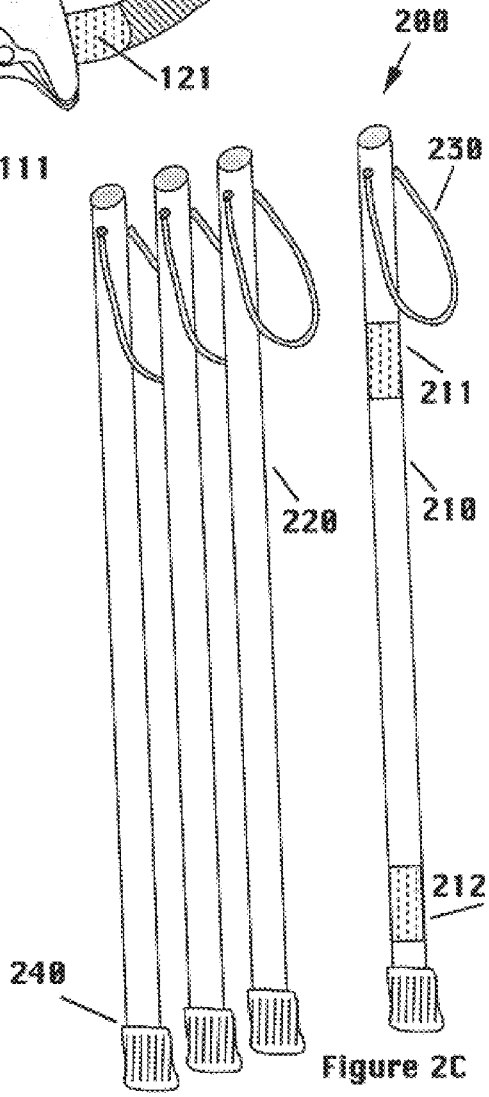
FIG. 2C illustrates the plurality of tubes which house the equipment in accordance with this invention.

As shown in FIG. 2C, the lead tube 210 has proximal and distal strips of hook-and-loop material, 211 and 212, affixed to the upper and lower ends of the tube. As illustrated in FIG. 1, the shoulder strap 140 and base carrying strap 320 are attached to said lead tube 210 via the hook-and-loop strips 211 connect to cross-piece 143 and 212 connecting to cross-piece 340. When the quiver is being used as a carrier, shoulder strap 140 and base strap 320 are fastened to one another by the respective buckles 142 and 310. Shoulder strap 140 may have attached thereto a padding 141 for added comfort. The protective tubes are bundled together at their distal ends by an encircling ring 330 and cross-piece 340. The described configuration facilitates carrying of the carrier over the shoulder.

FIG. 2A illustrates the spacer assembly 100. This assembly consists of a spacer 110 which has apertures 111 and 112 for providing a means for attachment. (See FIG. 3A.) The spacer 110 is provided with a plurality of strap apertures 112 for attaching the straps 120 thereto. The straps 120 are used for attaching peripheral equipment such as fencing gloves, body cords, water bottles, towels and so forth. In other ramifications, such as the device being used to carry other types of equipment, these straps 120 may be used to carry a variety of peripheral items. As can be gleaned in FIG. 1, shoulder strap 140 may be fastened to base strap 320 to facilitate carrying of the quiver 10 over the shoulder. The spacer 110 also has a plurality of tube apertures 111 arranged to hold said tubes a predetermined distance from each other.

FIGS. 2A–2C better illustrate each component of the quiver. FIG. 2A illustrates the spacer assembly 100. FIG. 2B shows the base assembly 300. FIG. 2C shows tube assembly 200. As discussed above, the spacer assembly 100 houses the straps 120 for attaching peripheral equipment. Straps 120 may be attached to the spacer 110 by threading them through apertures 112 and then attaching each strap to itself by sewing, gluing, rivets, snaps, or other known equivalent in the art. As illustrated, straps 120 each have hook-and-loop strips 121 and 125 which serve to fasten said peripheral equipment to spacer although other fasteners such as rivets, snaps, or other known equivalent in the art may also be used to attach said peripheral equipment. A clip fastener 130 may also be attached to straps 120 and also be employed to secure peripheral equipment such as gloves, towels, clothes, and so forth. As illustrated, a larger clip 135 is also attached to one of the straps 120 to be employed to attach the quiver to a chair or table or other furnishing. This larger clip could also be employed to attach larger peripheral equipment to the quiver. In other ramifications, the clip could be attached directly to the spacer or to the shoulder strap.

Figure 4:
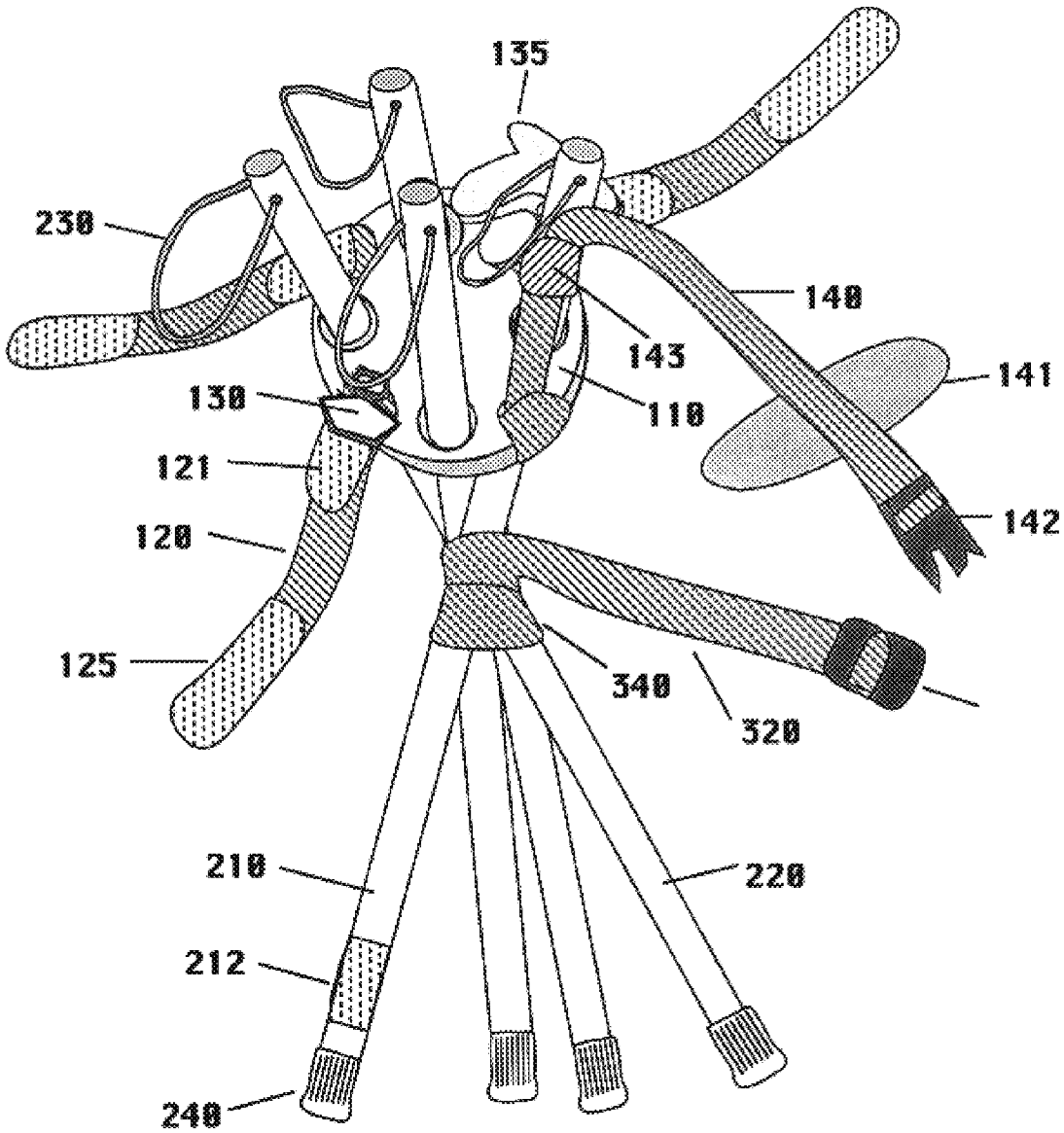
FIG. 4 is a front elevational view of the quiver configured as a stand.

FIG. 2B shows the base assembly 300. The base assembly comprises the base carrying strap 320 which is tied onto the encircling ring 330. This assembly also has a hook-and-loop cross piece 340 for attaching to lead tube 210 at the distal strip 212, and serves to stabilize said ring. The ring 330 serves two major functions. The first is to keep the base of said protective tubes 220 gathered at their lower ends when used as a carrier (as shown in FIG. 1). As shown in FIG. 4, ring 330 also encircles the mid-section of the tubes in conjunction with cross-piece 340 of base strap 320 to facilitate the splaying of tubes when the device is used as a stand. The ring may be comprised of a suitable semi-flexible, semi-rigid rubberized, elastomeric material. The ring should be constructed of such rigidity that the ring tightly embraces the tubes, but of sufficient, limited flexibility for facilitating lateral movement up the tubes when converting into a stand.

Figure 6:
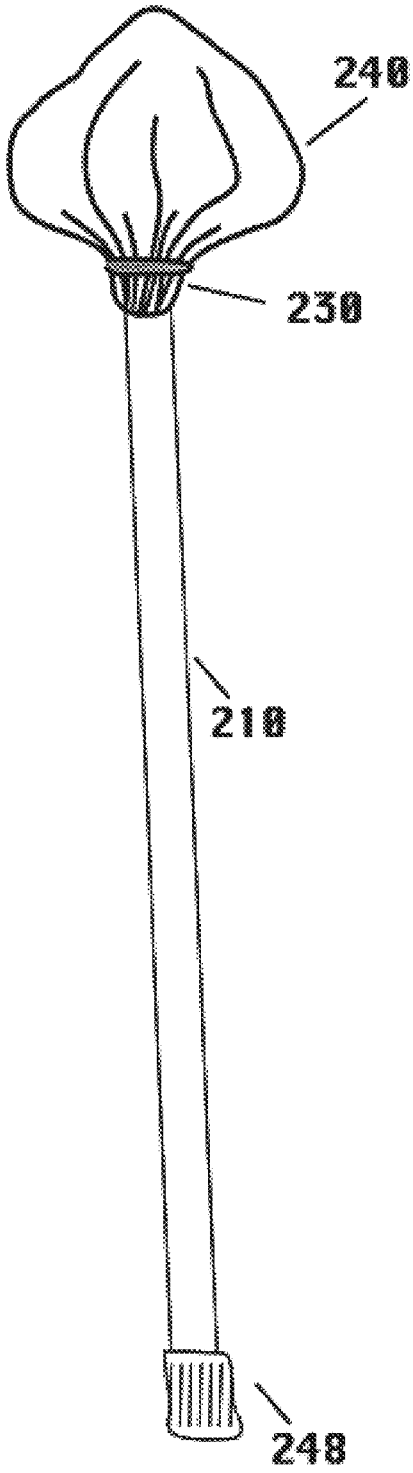
FIG. 6 illustrates a tube with a protective cap.

FIG. 2C shows the plurality of tubes 200 as having three tubes 220 and one lead tube 210, however more or fewer tubes, than those illustrated herein, may be employed. Each tube has a cord 230 made of a flexible material attached to the open end of each said tube for securing a fencing weapon to said tube. In lieu of cords, the tubes may also have protective caps serving as securing means, as illustrated here FIG. 6. Each tube is a rigid, hollow receptacle closed at one end by a plug 240. These plugs serve as a base when the device is converted into a stand. The plugs may be made of any suitable friction-enhancing material, such as rubber or any similar polymer. The friction aides in keeping the tubes in place on a floor surface when the quiver is being used as a stand.

Figure 3A:
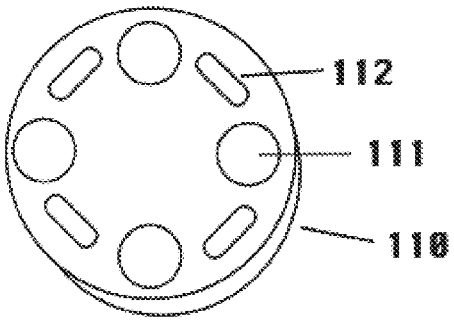
FIG. 3A is a front elevational view of the spacer used in holding a plurality of tubes in accordance with this invention.

As FIGS. 2A–2C show, the components comprising the device, FIGS. 3A–3E illustrate each of the elements of said components. FIG. 3A better illustrates the spacer 110. The spacer may have a plurality of apertures 111 for housing the tubes. A plurality of strap apertures 112 may be alternatively placed between said tube apertures. Said apertures may be in an alternating formation to allow for appropriate spacing for tube placement, which subsequently facilitates balance when used as a stand.

The spacer 110 may be formed unitarily from a single piece of rigid material. Aluminum, fiberglass and various lightweight wood or metal materials may also be employed. Known molding techniques and manufacturing processes may be used to construct the tubes and spacer.

Figure 3B:
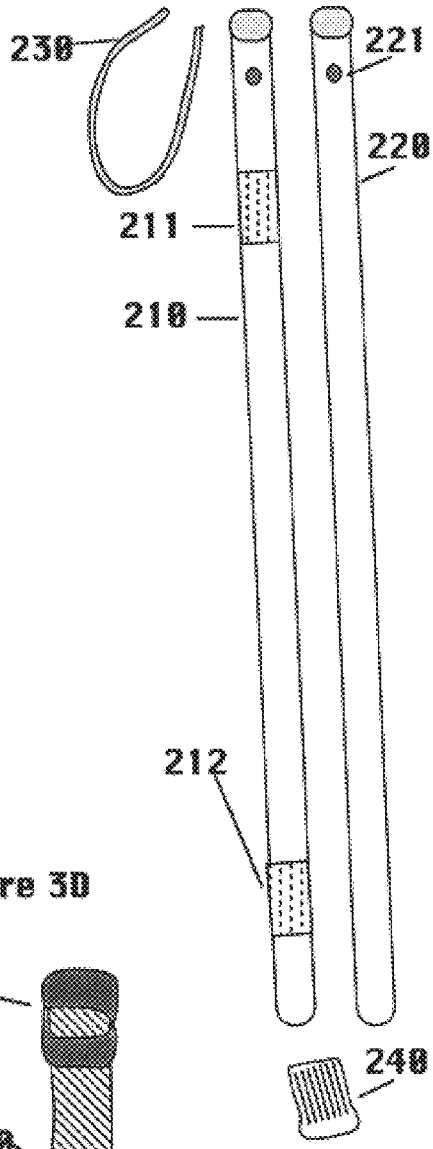
FIG. 3B is a plan view of the tubes.

FIG. 3B illustrates the structure of the tubes in detail. Said tubes are of sufficient length to fully ensheath a weapon blade. The tubes can be formed of a light-weight material such as, but not limited to, a suitable thermoplastic or light metal such as aluminum. Known molding techniques and manufacturing processes may be used to construct the tubes. The tubes are of a size to slidably accept the weapon, or rod-like equipment, without binding. If thermoplastic tubes are used, the lower end portions may be heated during manufacture, until slightly plastic and enlarged to provide a plug-like base surface area.

Figure 3C:
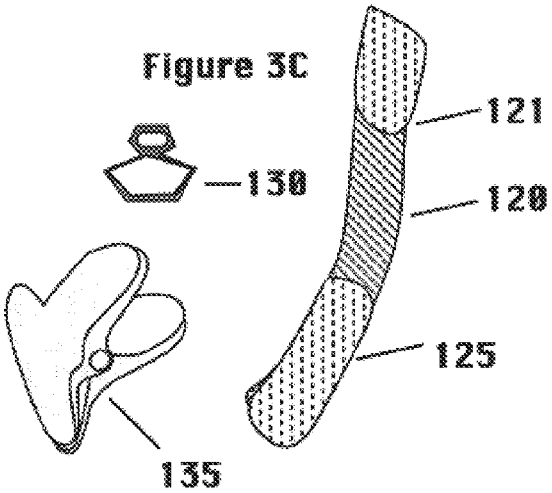
FIG. 3C is a frontal view of strap and clip means for attaching to the spacer and thus carrying peripheral tools and equipment, in accordance with the present invention; and a clip means for attaching the spacer to furnishings to hold it upright in its carrying form.
Figure 3D:
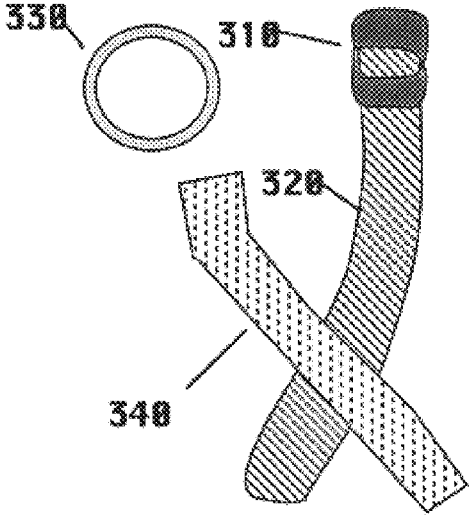
FIG. 3D is a plan view of the components of the base assembly.

One of the protective tubes is designated a lead tube 210 in that it has circular strips of hook-and-loop material 211 and 212 affixed to both the proximal end and the distal end of the tube. These strips provide means for attachment as the upper strip 211 attaches the lead tube to the spacer assembly 100 and the lower strip 212 attaches the lead tube to the base assembly 300. FIG. 3C illustrates a preferred embodiment of a strap which is to be used for attaching the peripheral equipment and tools to the spacer. The strap may be constructed from a durable and flexible cloth material. Examples of such material can include an array of natural or synthetic material used singularly or in combination, e.g., a tightly woven cotton or cotton blend. The straps are constructed of sufficient length such that the corresponding hook-and-loop strips (121 & 125) may meet and secure to one another as the strap is folded over.

In an alternate embodiment, lead tube 210, may also have a small wheel, or set of wheels, affixed to the base of the tube to facilitate movement. FIG. 5A illustrates such an embodiment of the equipment carrier having wheels. These wheels 350, as illustrated in FIG. 5B, are connected by an axle 352 in a sheath 351; the sheath is threaded through the tubes below the ring 330 and above the cross piece 340. FIG. 5C shows the wheel assembly. A wheel or wheels 350 can be attached to the lead tube, to the spacer assembly, or, as shown here, inserted between the tubes below the ring 330 and above the cross-piece 340 of base strap 320 to allow the quiver to be rolled as well as carried.

Operation of Preferred Embodiment

In this embodiment, assembling the quiver involves inserting said tubes into apertures of said spacer and into said ring of said base assembly. Said lead tube is then fastened to said shoulder strap by encircling said hook-and-loop cross-strap around said lead tube to join with hook-and-loop material affixed near the top of said lead tube. Said plurality of tubes is then secured to said base assembly by encircling said plurality of tubes below said ring with said hook-and-loop material cross-strap of said base assembly. If said quiver is to be rolled rather than carried over the shoulder, said wheel assembly is inserted between said tubes with said base ring above and said base-assembly cross piece below. Finally said shoulder strap and said base carrying strap are buckled together so that the assembled quiver can be carried over one shoulder. Weapons can be inserted and removed from the tops of said tubes, fastening the weapons into said tubes by means of said cords, as required. Peripheral equipment such as gloves, body cords, towels, and so forth, can be attached and removed from said hook-and-loop straps and said clips fastened to said spacer.

Figure 7:
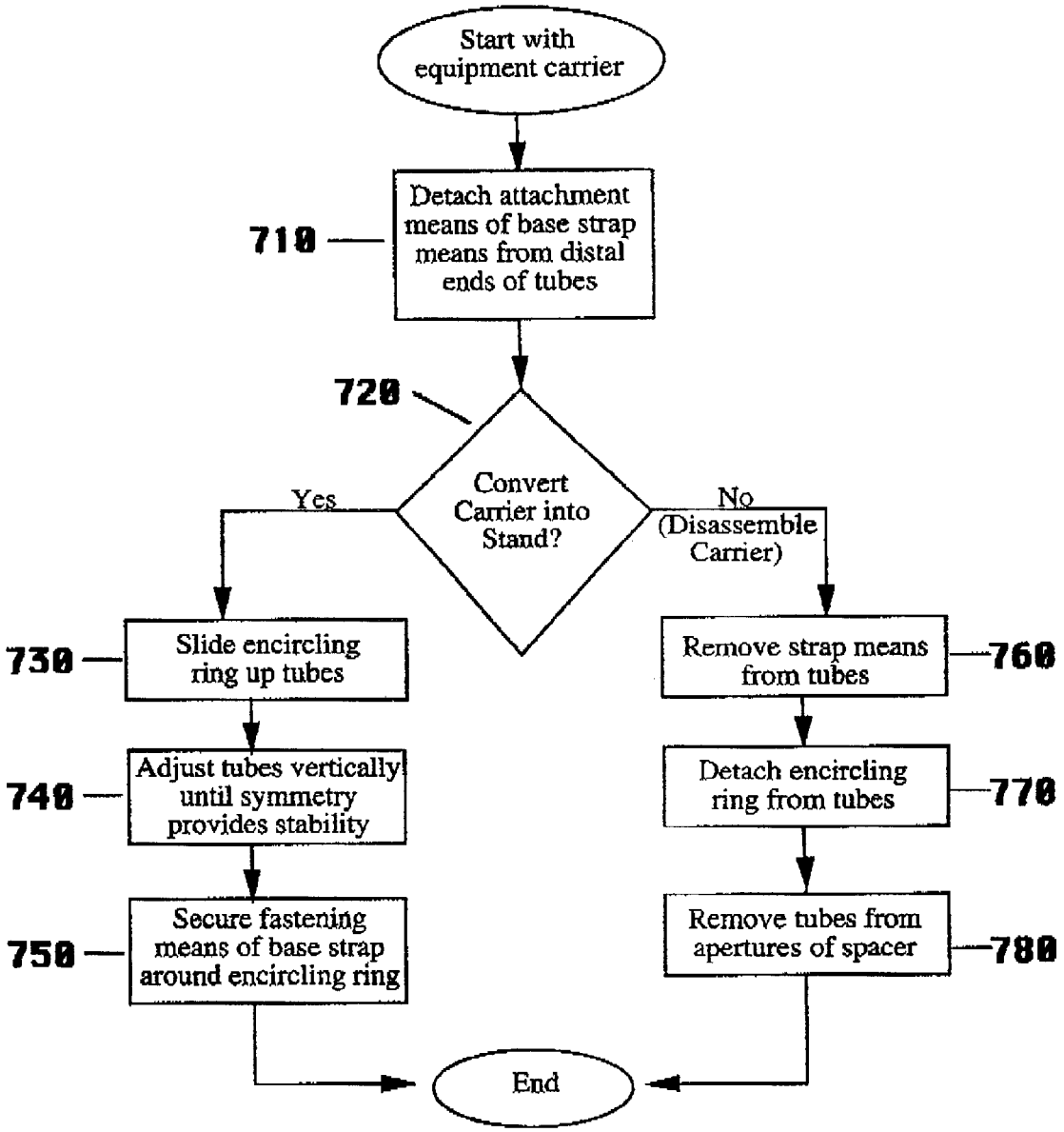
FIG. 7 is a flow chart of the method steps in accordance with the present invention.

Converting the quiver into a stand, as illustrated in FIG. 7, requires undoing said hook-and-loop material encircling said base ring 710 and sliding said base ring up said tubes toward said spacer 730. As said ring moves up said tubes, said closed ends of said tubes move away from each other, forming an increasingly stable footing. When said ring is above the middle of said tubes, said quiver has been converted into a stand 720, with said tubes as its legs. One or more tubes may require adjustment vertically to ensure symmetry and balance 740; then said hook-and-loop material attached to said base ring should again encircle said ring, stabilizing the structure 750.

Disassembling the quiver requires unfastening said hook-and-loop material of said shoulder strap 760 and said base carrying strap 710 from said hook-and-loop areas of said lead tube and then removing each of said tubes from said base 770 and said spacer 780. Any weapons in said tubes can remain in said tubes for safer transport and any peripheral equipment attached to said spacer can remain attached so that the multiple pieces remain a single entity.

CONCLUSION, RAMIFICATIONS, AND SCOPE

While the above description contains many specifics, these should not be construed as limitations on the scope of the quiver, but rather as an exemplification of one preferred embodiment thereof.

Other ramifications of this product could include quivers for carrying elongated sporting equipment or tools which require a carrying case of such a length as to be cumbersome for people of ordinary height to carry, which are inconvenient to carry by hand when there are other things that also need to be carried or when the hands could be used for other purposes, which could be damaged unless separated while being carried, or which might be damaged if left on the ground unprotected.

Many other variations are possible such as protective coverings above tubes or padding within tubes for fragile items; tubes might have variations in their external or internal shape, depending on design features and the shape of the items to be carried; the tubes might be closed at both ends or neither end; fasteners and containers for peripheral equipment might include pouches, bags, snap-on fasteners or other means for suspending useful items from the spacer assembly; and some embodiments might include more than one shoulder strap or shoulder straps that have fasteners for other peripheral equipment. The quiver, if used for elongated and fragile tools such as carpenter's levels, would require protective tubes which are longer than the equipment to be carried and require means for closing both ends of said tubes to provide greater protection from moisture or foreign bodies.

If used for other elongated sporting equipment, such as golf clubs or fishing rods, the tubes could have soft pads or weather-protective coverings attached at the upper, open ends to maximize protection against jostling, rain, dust, or other potentially damaging exposure. If used for gardening tools, such as short trowels or weeding forks or long spades or rakes, tubes would be sized to the implement so the quiver could be suspended over the shoulder while working, whether that work involve standing, kneeling, or sitting.

The operation of the quiver in these embodiments would remain substantially the same, with the assembled quiver holding tools or equipment within protective sheaths, allowing other equipment or tools to be attached to the main structure, and the entire entity to be hung from a human shoulder, chair, or other furnishing or clipped to such furnishing. Of course, the quiver could also be converted into a stand to hold tools or equipment upright and to give easy access, as required. The quiver, when disassembled, would require less volume for storage or transport within another container and its sheaths could continue to provide protection to their contents.

When this quiver is used in other ramifications, it provides protection against jostling of items carried within the tubes, along with convenient transport and easy access for items which are typically cumbersome because of their elongated and irregular shapes. The quiver itself is lightweight and sturdy, adding little weight beyond the weight of the items being carried.

Between locations other than within competition venues, the quiver is easily disassembled to travel within a zippered cloth travel bag or hard-sided travel case. In its space-efficient disassembled state, it protects equipment against jostling and the moisture of damp uniforms. Assembled, it is also a more convenient way to transport weapons and other equipment than hand-carrying where short distances or mode of transport might make hand-carrying feasible.

As such, those skilled in the art will appreciate that the conception, upon which this disclosure is based, may readily be outlined as a basis for the designing of other structures, methods, and systems for carrying out the several purposes of this invention. It is important, therefore, that the claims be regarded as including such equivalent constructions insofar as they do not depart form the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The specification is not intended to be limiting as to the scope of the invention in any way.

Accordingly, the scope of the quiver should be determined not by the embodiments described and illustrated, but by the appended claims and their legal equivalents.

We claim:

1. A quiver apparatus for carrying and protecting elongated equipment, said quiver comprising:

a plurality of rigid rod-like tubes of sufficient length and internal diameter to accommodate items to be carried and each having a proximal end and a distal end; and a spacer assembly having a spacer comprised of a rigid material with a plurality of apertures; and a base assembly for gathering the plurality of tubes together; and a carrying attached to said spacer and to said base assembly for supporting the structure on a human body, wherein said tubes are held separated from each other at their proximal ends by said spacer assembly and held close together at their distal ends by said base assembly; and said spacer assembly further comprises strap means for carrying peripheral tools and equipment, and said strap means consisting of a plurality of straps each having a proximal end and a distal end;

connecting means, affixed to said strap means, for securing said peripheral tools and equipment; and attachment means affixed to said proximal ends of said plurality of straps for attaching said straps to said spacer assembly.

2. The quiver of claim 1 wherein, said connecting means comprises the group consisting of clips, rivets, snaps, and hook-and-loop material affixed to said strap means.

3. The quiver of claim 1 wherein, said carrying means further comprises a shoulder strap means and a base strap means, said shoulder strap means further having adhesive means for simultaneous coupling to a lead tube having strip adhesive means on said proximal end;

said shoulder strap means having a first fastening mean for operatively connecting to a second fastening means provided on said base assembly to thereby form a harness to carry said equipment holder.

4. The quiver of claim 3 wherein, said first and second fastening means comprising the group consisting of interlocking connectors such as buckles, snaps and the like.

5. The quiver of claim 4 wherein, said base assembly further comprising an encircling ring for bundling the distal ends of said tubes together when said quiver is employed as a carrier.

6. The convertible quiver of claim 5 wherein, said ring is comprised of a semi-rigid elastomeric material.

7. The quiver of claim 5 wherein, said encircling ring is attached to said base strap, means said base strap having wrapping adhesive means for coupling to strip adhesive means on said distal end of said lead tube to stabilize said encircling ring.

8. The quiver of claim 5 further comprising wheel means for rolling said apparatus, said wheel means consisting of at least one set of wheels, said wheel means further comprising a rod for mounting said set of wheels, said rod adapted to be removably secured between said encircling ring and attachment means of said base strap means.

9. The quiver of claim 1 wherein, said plurality of tubes having a set of apertures at the proximal ends of each of said tubes; and cord means adapted to fit inside each of said set of apertures for securing the proximal ends of said tubes.

10. An equipment holder for carrying equipment, said holder comprising:

protective housing means comprising a plurality of rigid tubes for housing said equipment having proximal and distal ends;

spacing means for providing space between said proximal ends of said protective housing means;

encircling means for gathering said distal ends of said protective housing means; and said protective housing means further comprising a lead tube means for connecting the protective housing means to both the spacing means and the encircling means; and said protective housing means consisting of a plurality of tubes having sufficient length and internal diameter to fully ensheath said equipment; and said spacing means being comprised of a rigid material and having a plurality of apertures;

strap means, having proximal and distal ends, for attaching peripheral tools and equipment to said spacing means; and said encircling means further comprises a ring and a base strap;

said lead tube means comprising attachment means affixed to said lead tube for connecting said base strap to said lead tube; and a shoulder strap have connecting means for operatively connecting to said attachment means on said lead tube; and said shoulder strap further comprises a first interlocking connector; and said base strap having a second interlocking connector, said first and second connectors adapted for coupling to one another thus forming carrying means for carrying said equipment holder; and said encircling means has stabilizing means at the distal ends for maintaining placement when in use as a stand.

11. A method of converting an equipment carrier into different configurations, said method comprising the steps of:

providing an equipment carrier having:

a plurality of rigid tubes of sufficient length and internal diameter to accommodate items to be carried, each of said tubes having a proximal and a distal end; and a spacer assembly having a spacer comprised of a rigid material with a plurality of apertures; and a base assembly for gathering the plurality of tubes together, wherein said tubes are held separated from each other at their proximal end by said spacer assembly and held close together at their distal end by said base assembly;

said spacer assembly further comprising strap means for carrying peripheral tools and equipment; and said strap means consisting of a plurality of straps each having a proximal end and a distal end;

strip adhesive means, affixed to said straps, for securing said peripheral tools and equipment; and attachment means affixed to each of the proximal ends of said plurality of straps for attaching said straps to said spacer assembly;

shoulder strap means attached to said spacer, said shoulder strap means having a first interlocking connector, and said base assembly further comprising an encircling ring; and base strap means attached to said encircling ring for bundling the distal ends of said tubes together when said quiver is employed as a carrier;

said base strap means comprising a secondary interlocking connector for coupling to said first interlocking connector of said shoulder strap means;

said base strap means further comprising wrapping adhesive means for coupling to said plurality of tubes; and wherein said tubes are held separated from each other at their proximal ends by said spacer and held together at their distal ends by said encircling ring in conjunction with said base strap means; and said distal ends of said tubes each having base friction means for stabilizing said quiver when in use as a stand;

detaching said attachment means which encircles said base strap involves;

sliding said encircling ring up said tubes toward said spacer such that the distal ends of said tubes splay outward moving away from one another forming an increasingly stable footing when said ring is above the middle of said tubes;

adjusting said tubes vertically to ensure symmetry and balance of the splayed distal ends of said plurality of tubes;

securing said fastening means by encircling said wrapping adhesive means of said base strap means around said ring to thereby stabilize said stand.

12. A method as in claim 11 further comprising the steps of, removing the base strap means from the tubes; and detaching the encircling ring from the distal ends of said plurality of tubes; and removing said plurality of tubes from the apertures of said spacer, such that said plurality of tubes are disconnected from the carrier and independent of each other.

* * * * *